US011787666B2

(12) United States Patent
Zobel

(10) Patent No.: US 11,787,666 B2
(45) Date of Patent: Oct. 17, 2023

(54) LIFTING APPARATUS

(71) Applicant: Brent Robert Zobel, Coolidge, AZ (US)

(72) Inventor: Brent Robert Zobel, Coolidge, AZ (US)

( * ) Notice: Subject to any disclaimer, the term of this patent is extended or adjusted under 35 U.S.C. 154(b) by 78 days.

(21) Appl. No.: 17/229,781

(22) Filed: Apr. 13, 2021

(65) Prior Publication Data

US 2021/0229959 A1 Jul. 29, 2021

Related U.S. Application Data

(63) Continuation-in-part of application No. 16/601,390, filed on Oct. 14, 2019, now abandoned, which is a continuation-in-part of application No. PCT/IB2018/052599, filed on Apr. 13, 2018.

(60) Provisional application No. 62/883,813, filed on Aug. 7, 2019, provisional application No. 62/484,977, filed on Apr. 13, 2017.

(51) Int. Cl.
*B66C 1/16* (2006.01)

(52) U.S. Cl.
CPC ..... *B66C 1/16* (2013.01)

(58) Field of Classification Search
CPC ..... B66C 1/102; B66C 1/16; B66C 1/223; B66C 1/30; B60R 2011/0071
USPC ..... 294/67.1, 67.4, 67.41
See application file for complete search history.

(56) References Cited

U.S. PATENT DOCUMENTS 1,733,728 A * 10/1929 Fullerton ..... B65D 7/14 206/322
2,679,121 A * 5/1954 Hoofer ..... G09F 3/20 248/316.4
3,220,623 A 11/1965 Bostwick
3,253,707 A * 5/1966 Gooding ..... B65D 71/0092 294/67.1
3,913,965 A * 10/1975 Muller ..... B66C 1/16 294/67.1
3,999,693 A 12/1976 Cooper
4,381,055 A * 4/1983 Picaud ..... B65G 17/20 198/803.14
4,809,891 A 3/1989 Patrin
4,973,094 A * 11/1990 Tana ..... B66C 1/28 294/81.54
5,903,645 A * 5/1999 Tsay ..... B60R 11/0241 248/316.4
6,039,227 A 3/2000 Stark
6,439,444 B1 8/2002 Shields
2006/0145461 A1 7/2006 Anderson
2010/0044999 A1 2/2010 Columbia
(Continued)

FOREIGN PATENT DOCUMENTS

WO WO2013126334 A1 8/2013

*Primary Examiner* — Dean J Kramer

(57) ABSTRACT

A lifting apparatus clamps around the sides of a gang box to facilitate lifting and transporting the gang box. The lifting apparatus has a pair of lifting brackets a set of mounting points and a lateral clamp. The mounting points are support protrusions that extend from the lifting brackets to facilitate affixing the lifting apparatus to the bang box. The lateral clamp is connected in between the brackets and provides the force required to clamp the lifting apparatus around the gang box. Thus preventing the lifting brackets from becoming dislodged from the gang box.

9 Claims, 7 Drawing Sheets

(56) References Cited

U.S. PATENT DOCUMENTS

2014/0131407 A1 5/2014 Reiseder

* cited by examiner

LIFTING APPARATUS

The current application is a continuation-in-part (CIP) application of a U.S. non-provisional application Ser. No. 16/601,390 filed on Oct. 14, 2019. The U.S. non-provisional application Ser. No. 16/601,390 claims a priority to a U.S. provisional application Ser. No. 62/484,997 filed on Apr. 13, 2017.

FIELD OF THE INVENTION

The present invention relates generally to a lifting device. Core specifically, the present invention relates to a harness that clamps around the sides of a gang box to facilitate lifting and transporting the gang box.

BACKGROUND OF THE INVENTION

The present invention can be used as part of a system for transporting a gang box between locations. This system comprises the transport frame for mounting a gang box onto a vehicle, and a bracket assembly for lifting a gang box. The bracket assembly is designed to be a reconfigurable harness that attaches to the gang box to form anchor points for a hoist. The method for implementing the system for transporting a gang box between locations is as follows.

The user attaches the bracket assembly to the gang box. The user then attaches the bracket assembly to the hoist. Next, the user lifts the bracket assembly and the attached gang box using the hoist. The user then, lowers the gang box into the box-receiving receptacle. Finally, the user disconnects the bracket assembly from the gang box. These steps are repeated in reverse when extracting the gang box from the box-receiving receptacle.

To achieve the above described functionality, the bracket assembly comprises a first lifting bracket, a second lifting bracket, a first tensioning member and a second tensioning member. The first lifting bracket is laterally attached to the gang box. Similarly, the second lifting bracket is laterally attached to the gang box, opposite to the first lifting bracket. As a result, the first lifting bracket and the second lifting bracket are able to form anchor points that evenly distribute the weight of the gang box when the gang box is being lifted by the hoist. The first tensioning member and the second tensioning member are connected in between the first lifting bracket and the second lifting bracket. Accordingly, the first lifting bracket and the second lifting bracket can be tightened around the lateral sides of the gang box. This enables the user to securely affix the bracket assembly to the gang box prior to lifting the gang box. Both, the first lifting bracket and the second lifting bracket include support tabs that can be inserted into recesses in the gang box and serve to create a more robust connection be first lifting bracket and the second lifting bracket.

DETAIL DESCRIPTIONS OF THE INVENTION

All illustrations of the drawings are for the purpose of describing selected versions of the present invention and are not intended to limit the scope of the present invention.

Figure 1:
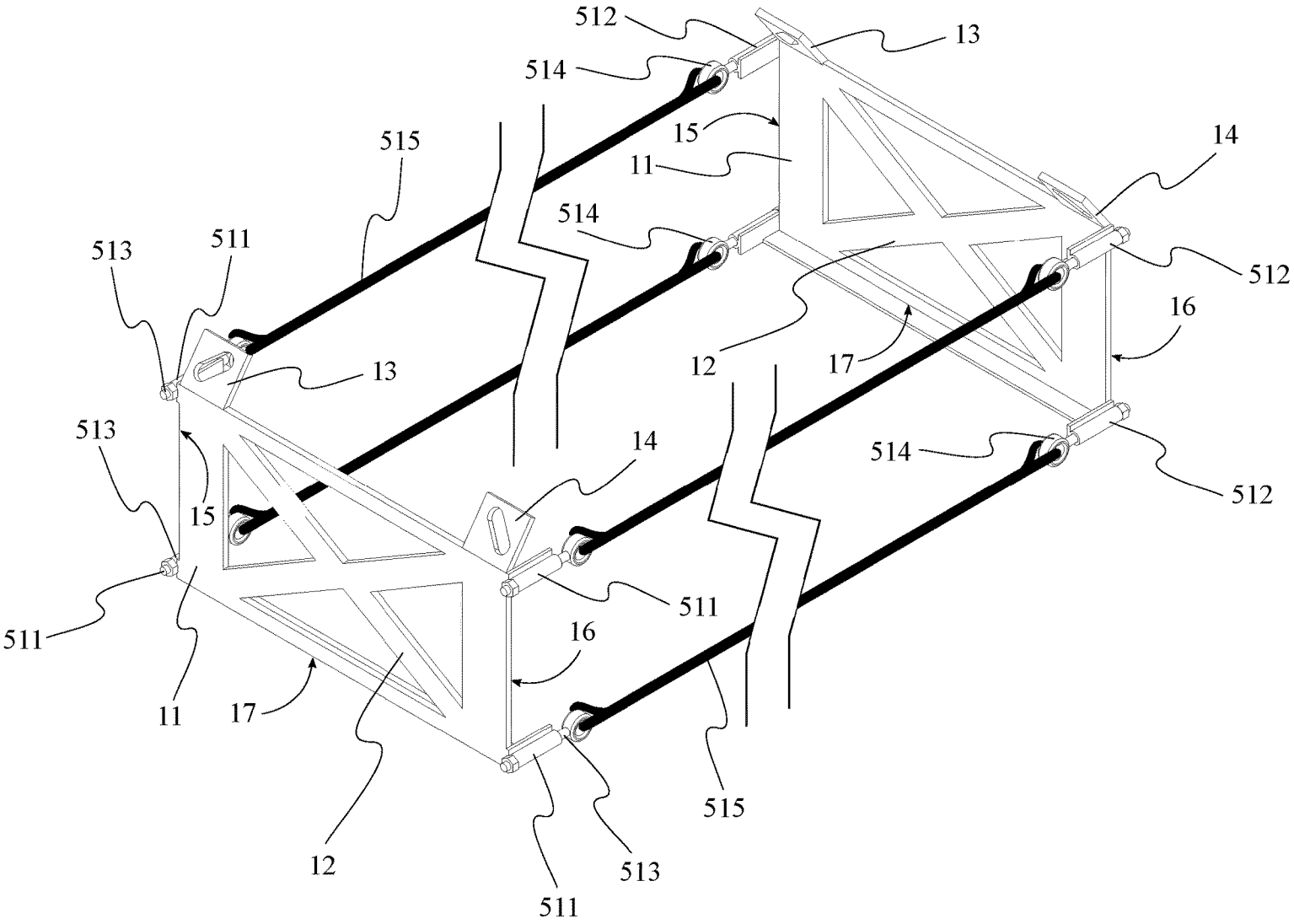
FIG. 1 is an isometric perspective view of the present invention.
Figure 7:
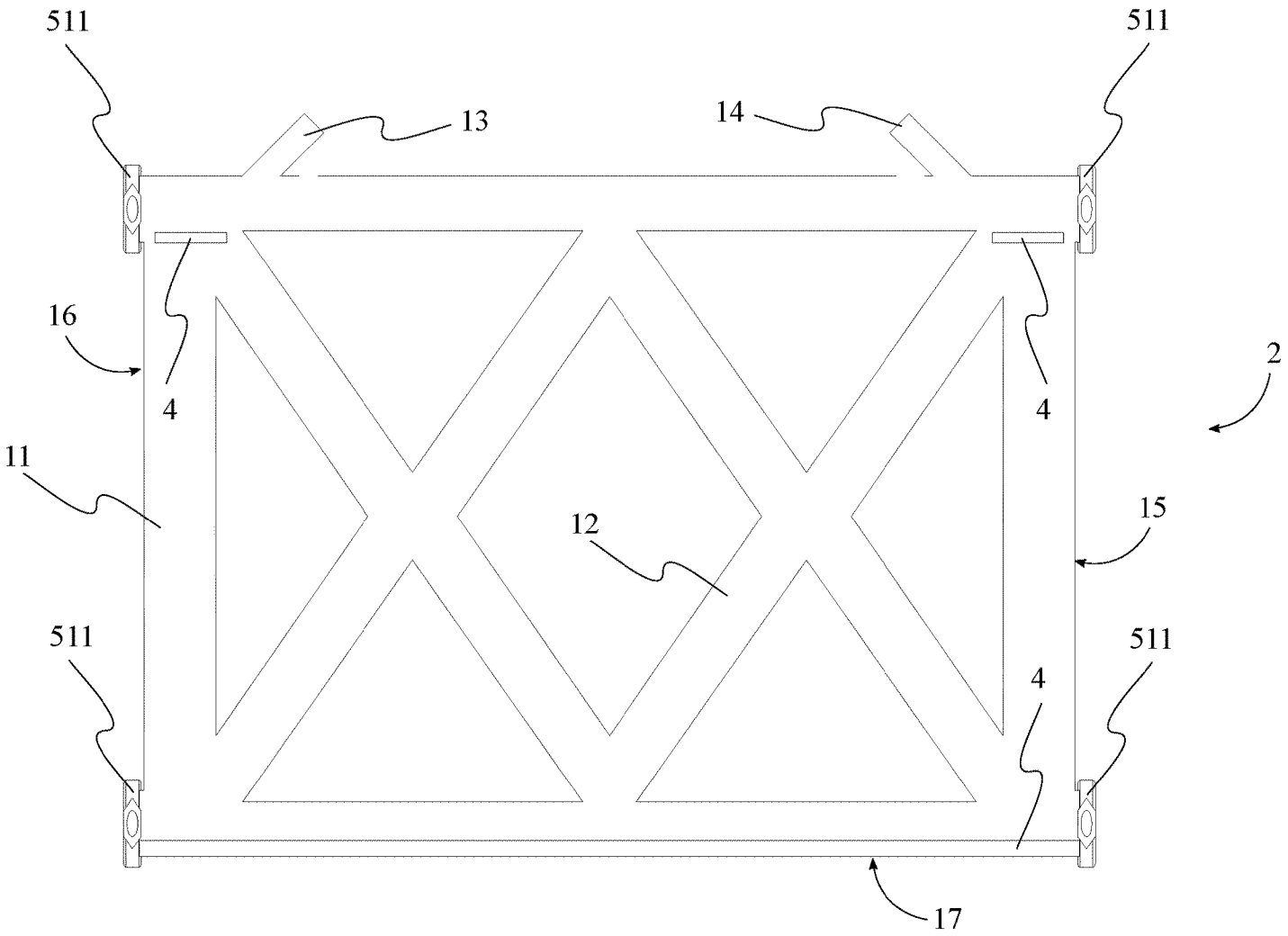
FIG. 7 is a left-side view of the second lifting bracket used in present invention.

Referring to FIG. 1, through FIG. 7, the present invention can be used as part of a system for transporting a gang box between locations. This system comprises the transport frame for mounting a gang box onto a vehicle, and a bracket assembly for lifting a gang box. The bracket assembly is designed to be a reconfigurable harness that attaches to the gang box to form anchor points for a hoist. The method for implementing the system for transporting a gang box between locations is as follows. The user attaches the bracket assembly to the gang box. The user then attaches the bracket assembly to the hoist. Next, the user lifts the bracket assembly and the attached gang box using the hoist. The user then, lowers the gang box into the box-receiving receptacle. Finally, the user disconnects the bracket assembly from the gang box. These steps are repeated in reverse when extracting the gang box from the box-receiving receptacle.

Figure 3:
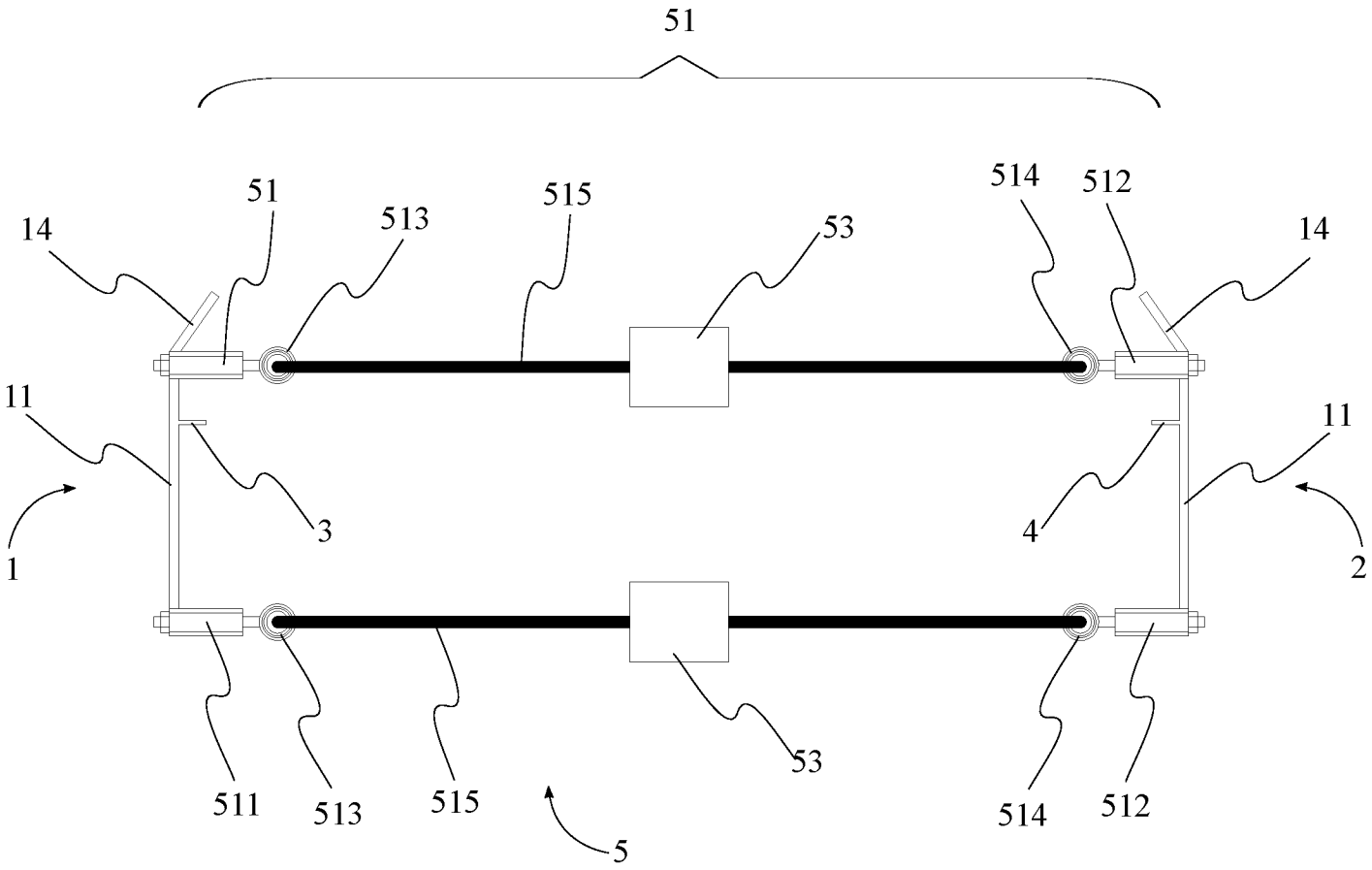
FIG. 3 is a front view of an embodiment of the present invention while attached to a gang box that is equipped with tensioning mechanisms along the tensioning members.

Referring to FIG. 1, and FIG. 3, to implement this system, the bracket assembly makes use of a pair of brackets that function as anchor points for the hoist. Specifically, the present invention comprises a lifting apparatus that is designed to clamp around the sides of the gang box, or any other container. The present invention enables the user to retrofit any gang box with anchor points that facilitate connecting the gang box to the hoist. To achieve the above-described functionality, the lifting apparatus comprises a first lifting bracket 1, a second lifting bracket 2, a first plurality of mounting points 3 a second plurality of mounting points 4, and a lateral clamp 5. The first plurality of mounting points 3 is distributed across the first lifting bracket 1. Similarly, the second plurality of mounting points 4 is distributed across the second lifting bracket 2. Thus positioned, the first plurality of mounting points 3 enables the first bracket to be affixed to the sides of the gang box and the second bracket to be affixed to the sides of the gang box. Additionally, the first plurality of mounting points 3 support the weight of the gang box while the gang box is suspended by the hoist.

Referring to FIG. 3, the lateral clamp 5 is an adjustable tethering system that is used to force the first lifting bracket 1 toward the second lifting bracket 2. Further, the lateral clamp 5 is connected in between the first bracket and the second bracket. Preferably, the first lifting bracket 1 and the second lifting bracket 2 are positioned on opposite sides of the gang box. The lateral clamp 5 forces the first lifting bracket 1 against a first side of the gang box and the second lifting bracket 2 toward a second side of the gang box. This clamping action causes the first plurality of mounting points 3 and the second plurality of mounting points 4 to engage into corresponding mounting features that are distributed across the gang box. The term "engagement feature" is used herein to refer to physical features of the gang box including, but not limited to, recesses, receptacles, flanges, shoulders, and coupling mechanisms.

Figure 5:
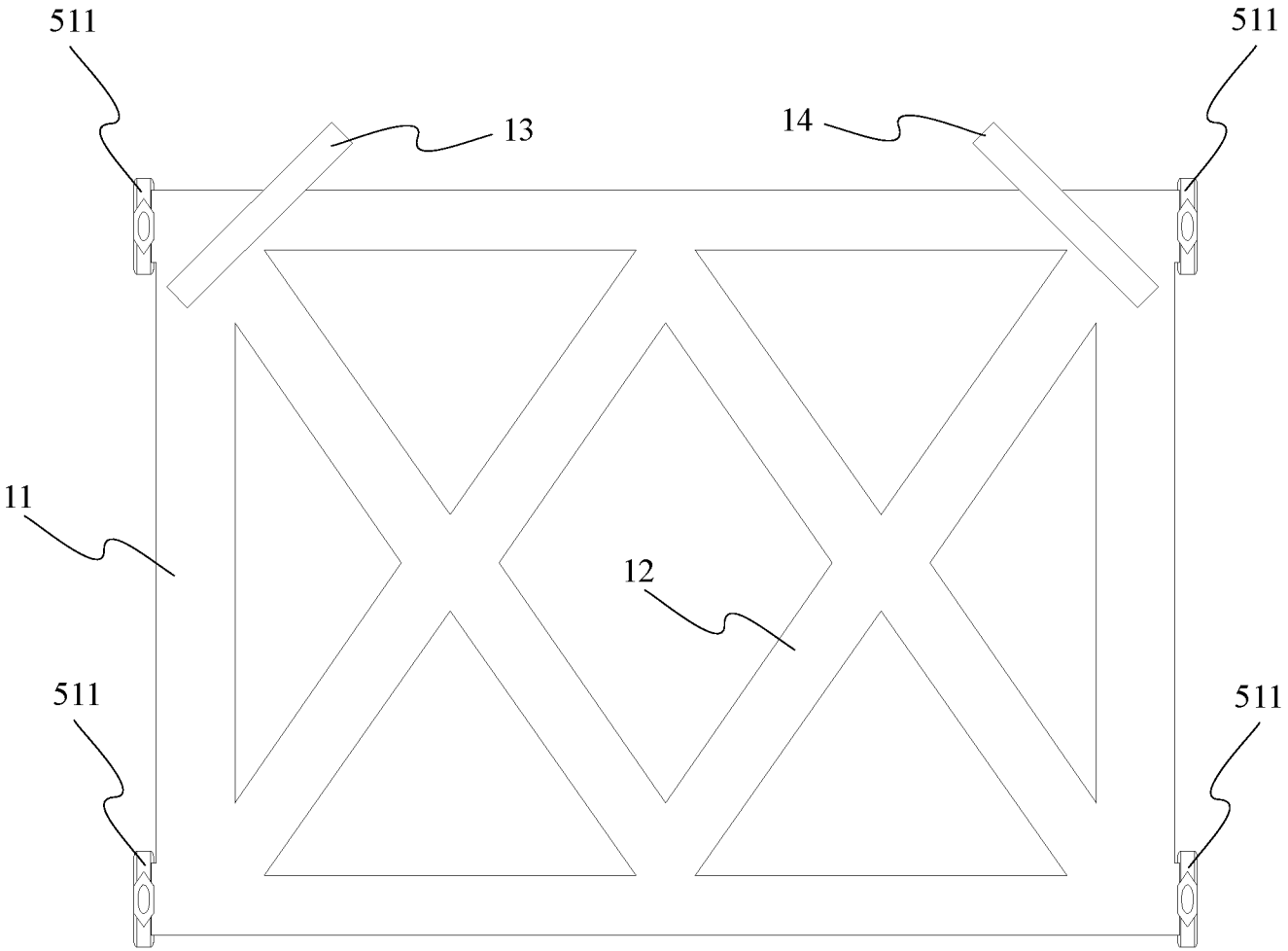
FIG. 5 is a left-side view of the first lifting bracket used in present invention.
Figure 6:
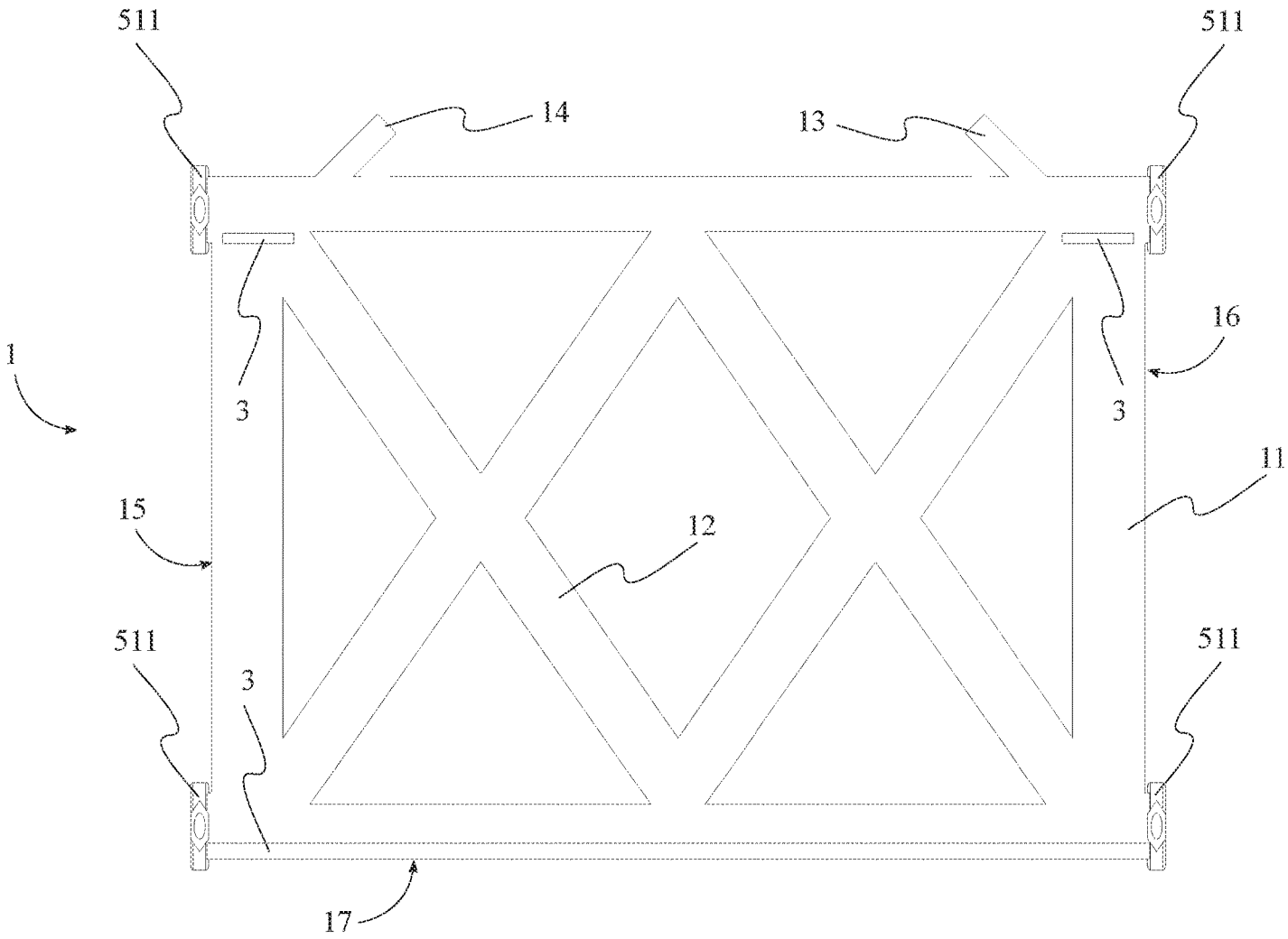
FIG. 6 is a right-side view of the first lifting bracket used in present invention.

Referring to FIG. 5, through FIG. 7, the first lifting bracket 1 and the second lifting bracket 2 are designed to transfer the load of the gang box into the hoist without damaging the gang box. To facilitate this functionality, the first lifting bracket 1 and the second lifting bracket 2 each comprise a bracket frame 11, a crossmember assembly 12, at least one first anchor point 13 and at least one second anchor point 14. The first bracket frame 11 is a rigid structure that defines the overall shape of each bracket. The crossmember assembly 12 is a support structure that is mounted within the bracket frame 11 Thus positioned, the crossmember assembly 12 distributes the weight of the gang box throughout the bracket frame 11. In some embodiments, the bracket frame 11 and the crossbar assembly form a reconfigurable bracket that can be attached to gang boxes of varying shape and size. The first anchor point 13 is laterally mounted onto the bracket frame 11 and is positioned opposite to the crossmember assembly 12, across the bracket frame 11. Similarly, the second anchor point 14 is laterally mounted onto the bracket frame 11 and is positioned opposite to the crossmember assembly 12, across the bracket frame 11. Further, the second anchor point 14 is positioned offset from the first anchor point 13 across the bracket frame 11. Thus positioned, the first anchor point 13 and the second anchor point 14 provide locations where the hoist can be tethered to the present invention. Additionally, the offset between the first anchor point 13 and the second anchor point 14 is designed to prevent the gang box from listing, or the hoist cables becoming twisted.

Figure 4:
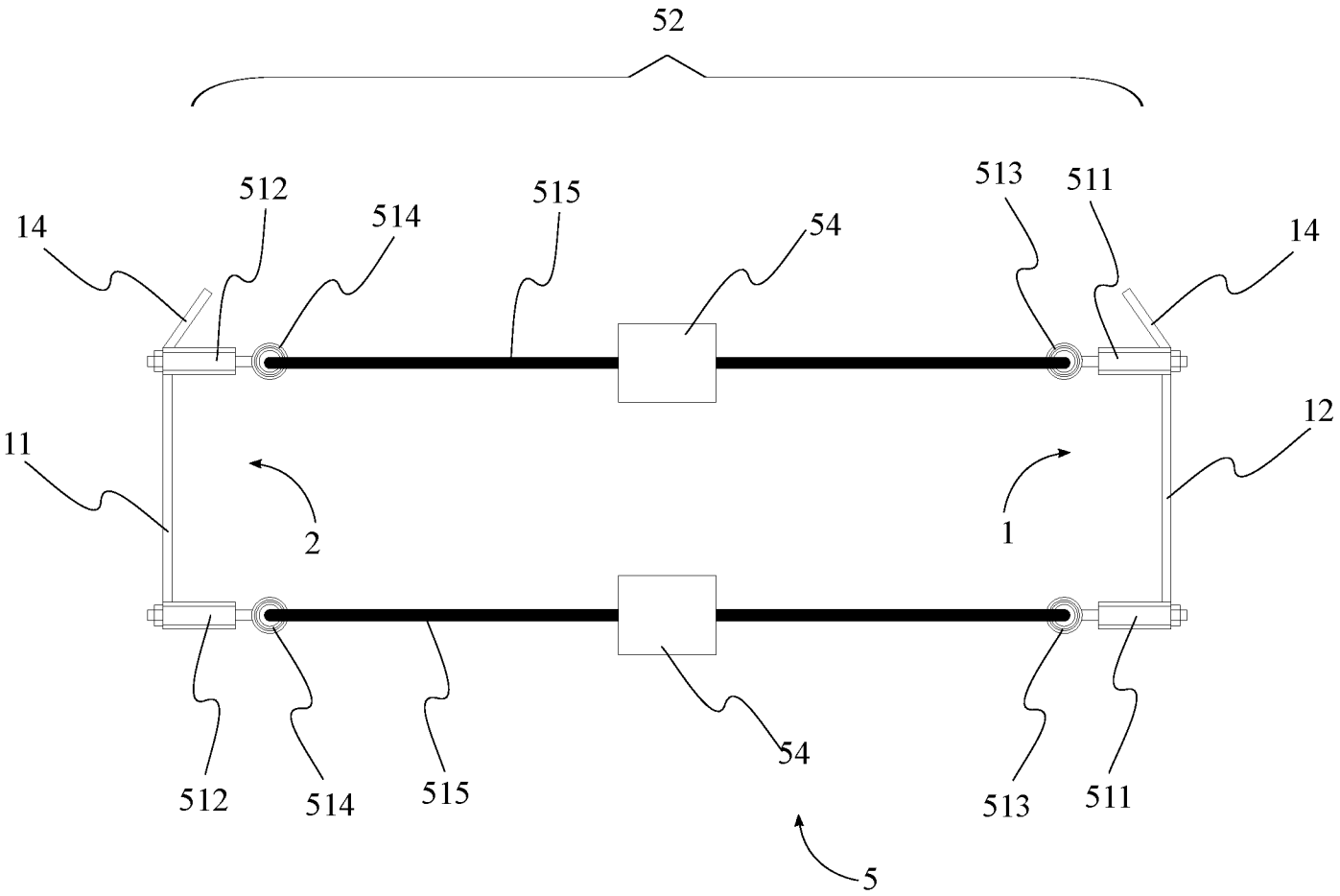
FIG. 4 is a rear view of an embodiment of the present invention while attached to a gang box that is equipped with tensioning mechanisms along the tensioning members.

Referring to FIG. 3, and FIG. 4, the lateral clamp 5 is designed to be an adjustable system that can accommodate gang boxes of varying shape and size. To that end, the lateral clamp 5 comprises at least one first tensioning member 51 and at least one second tensioning member 52. The first tensioning member 51 is connected in between a first lateral edge 15 of the first lifting bracket 1 and a first lateral edge 15 of the second lifting bracket 2. Likewise, the second tensioning member 52 is connected in between a second lateral edge 16 of the first lifting bracket 1 and a second lateral edge 16 of the second lifting bracket 2. Thus positioned, the first tensioning member 51 and the second tensioning member 52 form tethers that enable the present invention to be quickly deployed around both regular and irregularly shaped gang boxes.

To facilitate the aforementioned deployment, the first tensioning member 51 and the second tensioning member 52 each comprise a first mounting tab 511, a second mounting tab 512, a first eyelet bolt 513, a second eyelet bolt 514, and a cable 515. The connection arrangement is as follows: the first mounting tab 511 is connected to the first lifting bracket 1, the second mounting tab 512 is connected to the second lifting bracket 2, the first eyelet bolt 513 is rotatably connected to the first mounting tab 511, the second eyelet bolt 514 is rotatably connected to the second mounting tab 512, and the cable 515 is tethered in between the first eyelet bolt 513 and the second eyelet bolt 514. The user is able to deploy the present invention by connecting the first eyelet bolt 513 to the first mounting tab 511 and the second eyelet bolt 514 to the second mounting tab 512. Once the first tensioning member 51 and the second tensioning member 52 are connected in this way, the user can manipulate the connection between an arbitrary eyelet bolt and a corresponding mounting tab to adjust the tension in an associated tensioning member.

Referring to FIG. 1, and FIG. 3, in a supplemental embodiment, the lateral clamp 5 comprises at least one first tensioning mechanism 53 and at least one second tensioning mechanism 54. The first tensioning mechanism 53 and the second tensioning mechanism 54 are actuation mechanisms that govern the clamping force between the first lifting bracket 1, the second lifting bracket 2, and the gang box. Additionally, the first tensioning mechanism 53 and the second tensioning mechanism 54 can be any actuator selected from the group including, but not limited to, servomotors, worm gears, winches, and cam locks. The first tensioning mechanism 53 is operatively coupled to the first tensioning member 51, wherein the first tensioning mechanism 53 adjusts the tension in the first tensioning member 51. Likewise, the second tensioning mechanism 54 is operatively coupled to the second tensioning member 52, wherein the second tensioning mechanism 54 adjusts the tension in the second tensioning member 52. To further facilitate this, the first tensioning mechanism 53 and the second tensioning mechanism 54 may be coupled to a corresponding tensioning member at any point along a length of the corresponding tensioning member. In supplemental embodiments strain gauges are integrated into the first tensioning member 51 and the second tensioning member 52. In these embodiments the user is able to remotely access and control the first tensioning mechanism 53 and the second tensioning mechanism 54. Additionally, a plurality of environmental sensors may be integrated into the present invention. In supplemental embodiments, the data output by the plurality of environmental sensors is transmitted to a remote server for processing and delivery. The term "remote server" is used herein to refer to any computing system capable of coordinating the communication between a plurality of distributed components as well as executing a number if subroutines when employing the present invention. The data processed by the remote server is available to be accessed through a user computing device, and alerts for excessive strain or temperature can be transmitted to the user.

Figure 2:
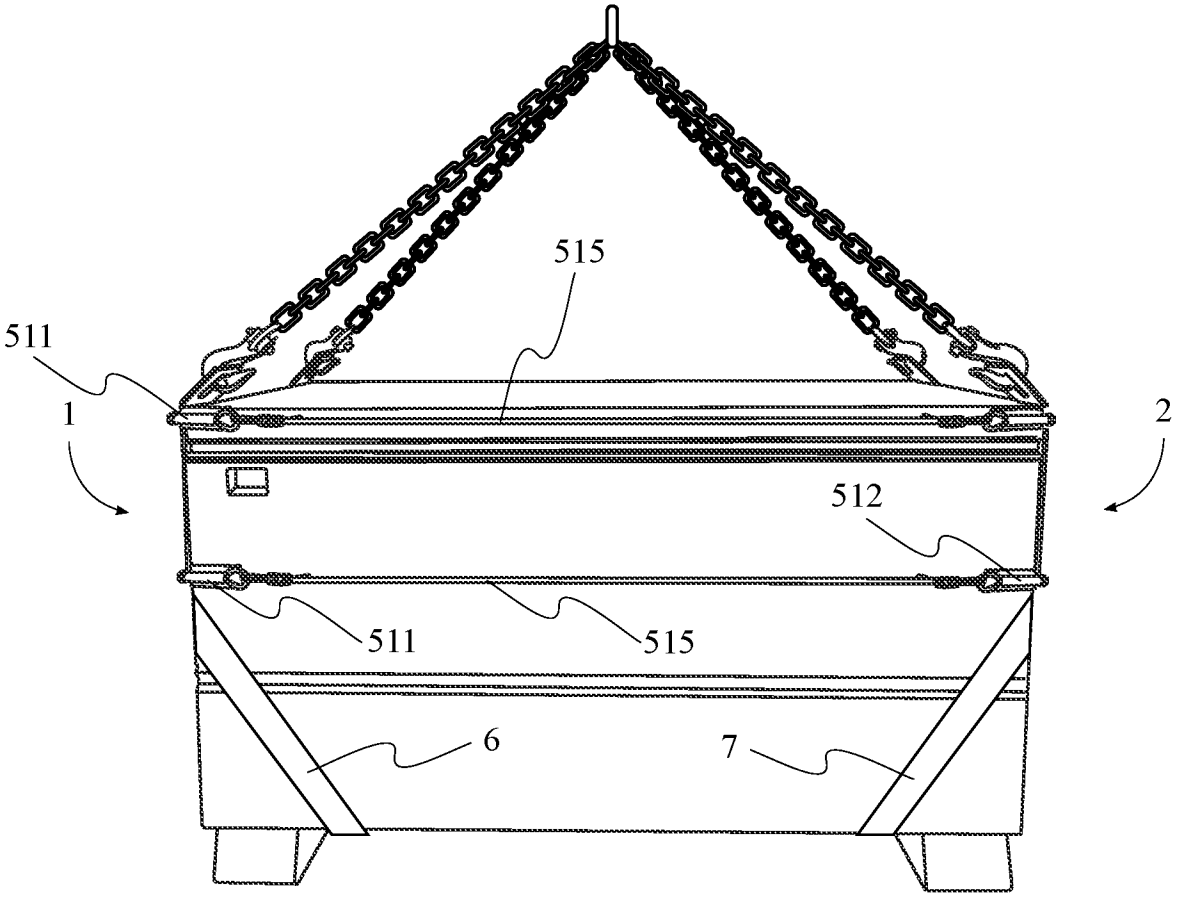
FIG. 2 is a front view of the present invention while attached to a gang box.

Referring to FIG. 1, and FIG. 2, The present invention is designed to provide a safe and stable lifting apparatus. To facilitate this functionality, embodiments of the present invention comprise a first stability harness 6 and a second stability harness 7. The first stability harness 6 is tethered along a lengthwise edge 17 of the first bracket so that the first stability harness 6 can support the underside of the gang box nearest to the first lifting bracket 1. The second stability harness 7 is tethered along a lengthwise edge 17 of the second bracket so that the second stability harness 7 can support the underside of the gang box nearest to the second lifting bracket 2. In some embodiments a lip extends into the gang box to press the gear stored within the gang box into a relatively flat and fixed configuration.

Although the invention has been explained in relation to its preferred embodiment, it is to be understood that many other possible modifications and variations can be made without departing from the spirit and scope of the invention as hereinafter claimed.

What is claimed is:

1. A lifting apparatus comprising:

a first lifting bracket;

a second lifting bracket;

a first plurality of mounting points;

a second plurality of mounting points;

a lateral clamp;

the first plurality of mounting points being distributed across the first lifting bracket;

the second plurality of mounting points being distributed across the second lifting bracket;

the lateral clamp being connected in between the first bracket and the second bracket;

the first lifting bracket and the second lifting bracket each comprising a bracket frame and a crossmember assembly;

the crossmember assembly being mounted within the bracket frame;

the first lifting bracket and the second lifting bracket each further comprising at least one first anchor point;

the first anchor point being laterally mounted onto the bracket frame; and the first anchor point being positioned opposite to the crossmember assembly, across the bracket frame.

2. The lifting apparatus as claimed in claim 1 comprising:

the first lifting bracket and the second lifting bracket each further comprising at least one second anchor point;

the second anchor point being laterally mounted onto the bracket frame;

the second anchor point being positioned opposite to the crossmember assembly across bracket frame; and the second anchor point being positioned offset from the first anchor point across the bracket frame.

3. The lifting apparatus as claimed in claim 1 comprising:

the lateral clamp comprising at least one first tensioning member and at least one second tensioning member;

the first tensioning member being connected in between a first lateral edge of the first lifting bracket and a first lateral edge of the second lifting bracket; and the second tensioning member being connected in between a second lateral edge of the first lifting bracket and a second lateral edge of the second lifting bracket.

4. The lifting apparatus as claimed in claim 3 comprising:

the first tensioning member and the second tensioning member each comprising a first mounting tab, a second mounting tab, a first eyelet bolt, a second eyelet bolt, and a cable;

the first mounting tab being connected to the first lifting bracket;

the second mounting tab being connected to the second lifting bracket;

the first eyelet bolt being rotatably connected to the first mounting tab;

the second eyelet bolt being rotatably connected to the second mounting tab; and the cable being tethered in between the first eyelet bolt and the second eyelet bolt.

5. The lifting apparatus as claimed in claim 1 comprising:

the lateral clamp comprising at least one first tensioning mechanism; and the first tensioning mechanism being operatively coupled to a first tensioning member, wherein the first tensioning mechanism adjusts the tension in the first tensioning member.

6. The lifting apparatus as claimed in claim 1 comprising:

the lateral clamp comprising at least one second tensioning mechanism; and the second tensioning mechanism being operatively coupled to a second tensioning member, wherein the second tensioning mechanism adjusts the tension in the second tensioning member.

7. The lifting apparatus as claimed in claim 1 comprising:

the lateral clamp comprising at least one second tensioning mechanism; and the second tensioning mechanism being operatively coupled to a second tensioning member, wherein the second tensioning mechanism is able to increase or decrease the tension in the second tensioning member.

8. The lifting apparatus as claimed in claim 1 comprising:

a first stability harness; and the first stability harness being tethered along a lengthwise edge of the first bracket.

9. The lifting apparatus as claimed in claim 1 comprising:

a second stability harness; and the second stability harness being tethered along a lengthwise edge of the second bracket.

* * * * *